United States Patent [19]

Eklund

[11] 4,437,320

[45] Mar. 20, 1984

[54] TRANSPORTER AIR CHILLER

[76] Inventor: Claes E. Eklund, 1347 W. Trenton Ave., Orange, Calif. 92667

[21] Appl. No.: 377,079

[22] Filed: May 11, 1982

[51] Int. Cl.[3] ..... F25B 27/00

[52] U.S. Cl. ..... 62/236; 62/239

[58] Field of Search ..... 62/236, 239, 243, 244, 62/240; 165/41, 42; 237/12.1

[56] References Cited

U.S. PATENT DOCUMENTS

| | | | |
|---|---|---|---|
| 4,027,727 | 6/1977 | Pullens | 62/236 |
| 4,240,581 | 12/1980 | Fowler | 237/12.1 |
| 4,272,967 | 6/1981 | White et al. | 62/236 |

*Primary Examiner*—Albert J. Makay
*Assistant Examiner*—Henry Bennett
*Attorney, Agent, or Firm*—Gordon K. Anderson

[57] ABSTRACT

A vapor cycle refrigeration air chiller having two separate refrigeration systems in a single unitized frame. The first system producing a continuous cooling effect when supplied with alternating current power from an external source. The second refrigeration system operates to cool eutectic plates during alternating current operation. Air distribution is modified by a damper integral with a transporter containing the chiller and airborne food tray carts. Cooled air enters the carts from the chiller for pulldown and storage during alternating current operation. For transportation the chiller utilizes a self-contained battery operated, direct current fan with the damper spring loaded open, allowing the air to circulate over the eutectic plates and then around the food tray carts maintaining product temperature.

7 Claims, 6 Drawing Figures

TRANSPORTER AIR CHILLER

BACKGROUND OF THE INVENTION

1. Field of the Invention

This invention relates in general to vapor cycle refrigeration units with alternate energy sources and dual refrigeration systems, more specifically to air chillers with air flow arrangements within transporters.

2. Description of Prior Art

Air chillers for transporters have previously used dry ice for transporting airborne food carts or have had no provisions during some operating cycles. Prior art has been limited to battery operated portable units, such as taught by Pullens in U.S. Pat. No. 4,027,727, where the entire refrigeration unit was operated by battery power, vastly limiting refrigeration capacity.

U.S. Pat. No. 3,733,849 issued to Cantagallo et al. discloses an air flow arrangement for a compartment through a single refrigeration system with only A.C. power for the electric motor driven equipment. Lorch, in U.S. Pat. No. 3,006,167 utilizes a eutectic tank having holdover plates integral with the structure for connection to a separate condensing system. Also, no forced air flow is provided to transmit the cooling effect to other areas or compartments. U.S. Pat. No. 3,255,812 issued to Bayane et al. indicates a portable food serving cart with separate sections, one for heating, and the other containing a vapor cycle refrigeration system gasketed together into one unit. The two sections are independent in operation and function.

For background purposes and as indicative of the art to which the invention relates, reference may be made to U.S. Pat. No. 3,111,166 issued to Muntz et al., U.S. Pat. No. 2,989,856 of Telkes, and also U.S. Pat. No. 3,168,368 issued to Schaefer-Sell.

SUMMARY OF THE INVENTION

In the air transportation food services industry, the need has existed for cost effective mechanical equipment for cooling, storing and conveying airborne food tray carts. Many individual systems have been utilized, but have not completely answered the need, especially with stricter government regulations and public demand.

The instant invention fills this need and it is, therefore, the primary object to provide a multi-purpose unit within a single frame that will provide cooled air flow through a plurality of entree carts to pull down the temperature in both the product and cart, while maintained or stored in a kitchen using conventional A.C. power. Further, the invention provides cooled air flow around the carts from a stored source using eutectic plates and a rechargeable D.C. battery operated fan for transportation from the kitchen to the aircraft. An important object is the ability of the chiller to fit into a transporter along with the entree carts and become an integral part of the air distribution system. The entire high pressure side of the refrigeration system is thoroughly isolated, allowing condenser air to circulate freely and not affect the cooling side of the system.

Another object improves the efficiency of the condenser with both refrigeration systems sharing the same condenser fan and coil. During A.C. operation simultaneous or individual operation is required. With the same extended heat transfer surface being used and the circuits interlaced when one system is deenergized, the residual effect is utilized by the remaining system. Also, as the surface is extended this also vastly improves the efficiency of the condenser which results in an ultimate saving of electrical power.

Still another object requires only a simple spring loaded solenoid actuated damper to change the air flow from being directed almost entirely through the entree carts to surround the external surface for D.C. operation. Considerable energy is conserved by using a low velocity, low pressure fan during battery operation not requiring the cooled air to be forced through the cart itself, which has considerably more air static resistance. As the cart and product will already be pulled down to temperature, the need for higher air flow and pressure is obviated. The damper itself is spring loaded open, eliminating the necessity to use electrical power during the battery operating transportation mode.

These and other objects and advantages of the present invention will become apparent from the subsequent detailed description of the preferred embodiment and the appended claims taken in conjunction with the accompanying drawings.

DESCRIPTION OF THE PREFERRED EMBODIMENT

Figure 1:
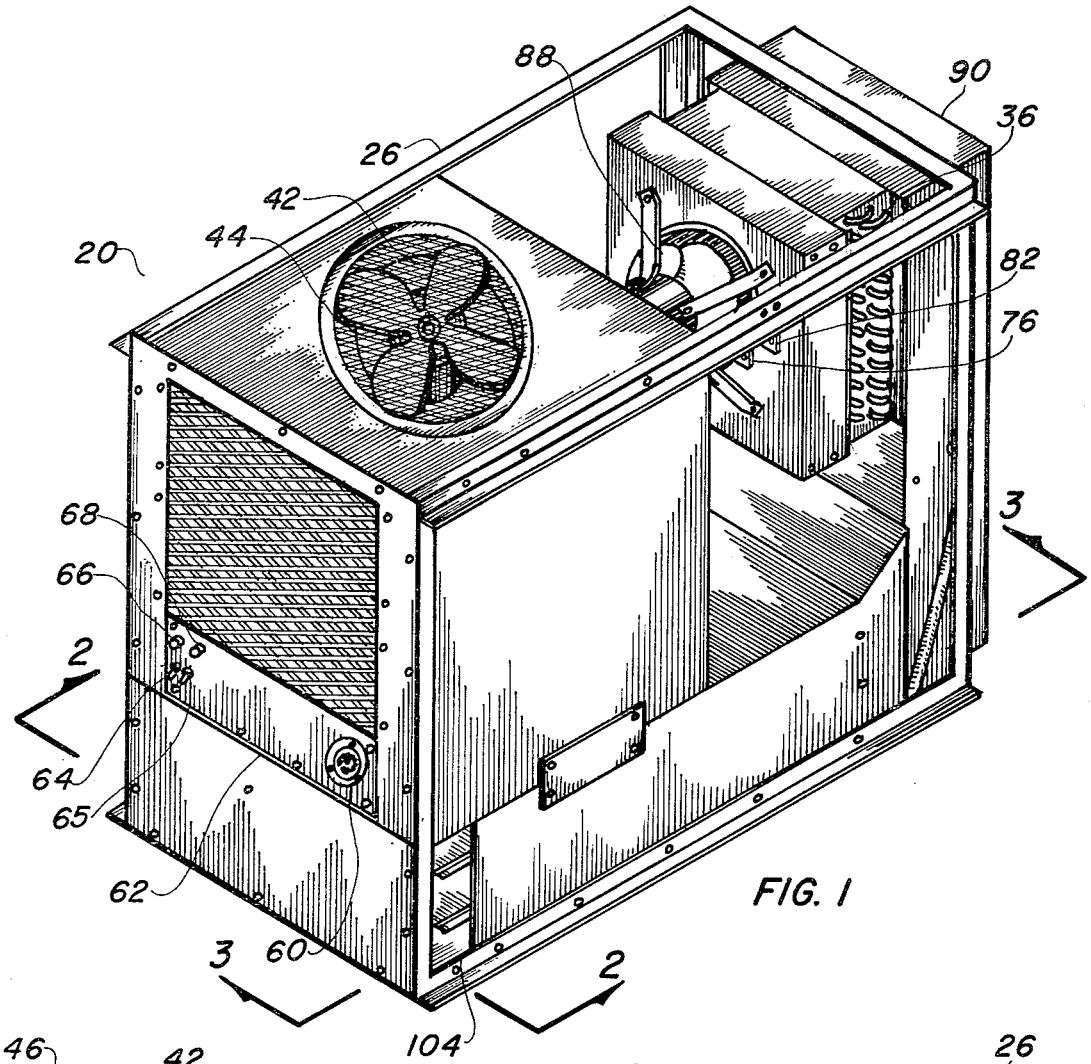
FIG. 1 is a partial isometric view of the preferred embodiment removed from the transporter.
Figure 2:
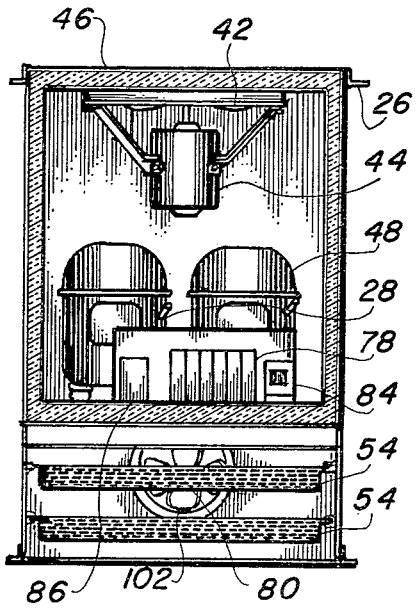
FIG. 2 is a sectional view taken along lines 2—2 of FIG. 1.
Figure 3:
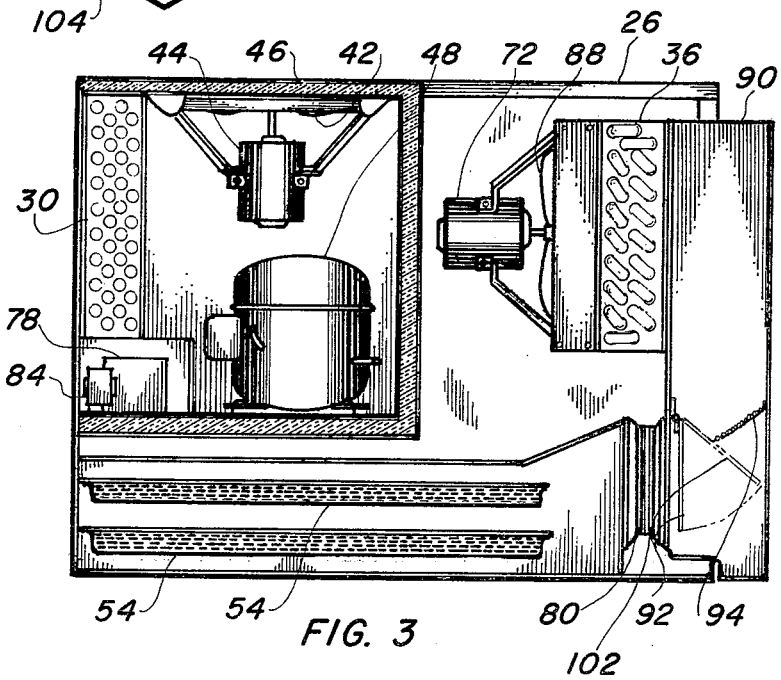
FIG. 3 is a sectional view taken along lines 3—3 of FIG. 1.
Figure 4:
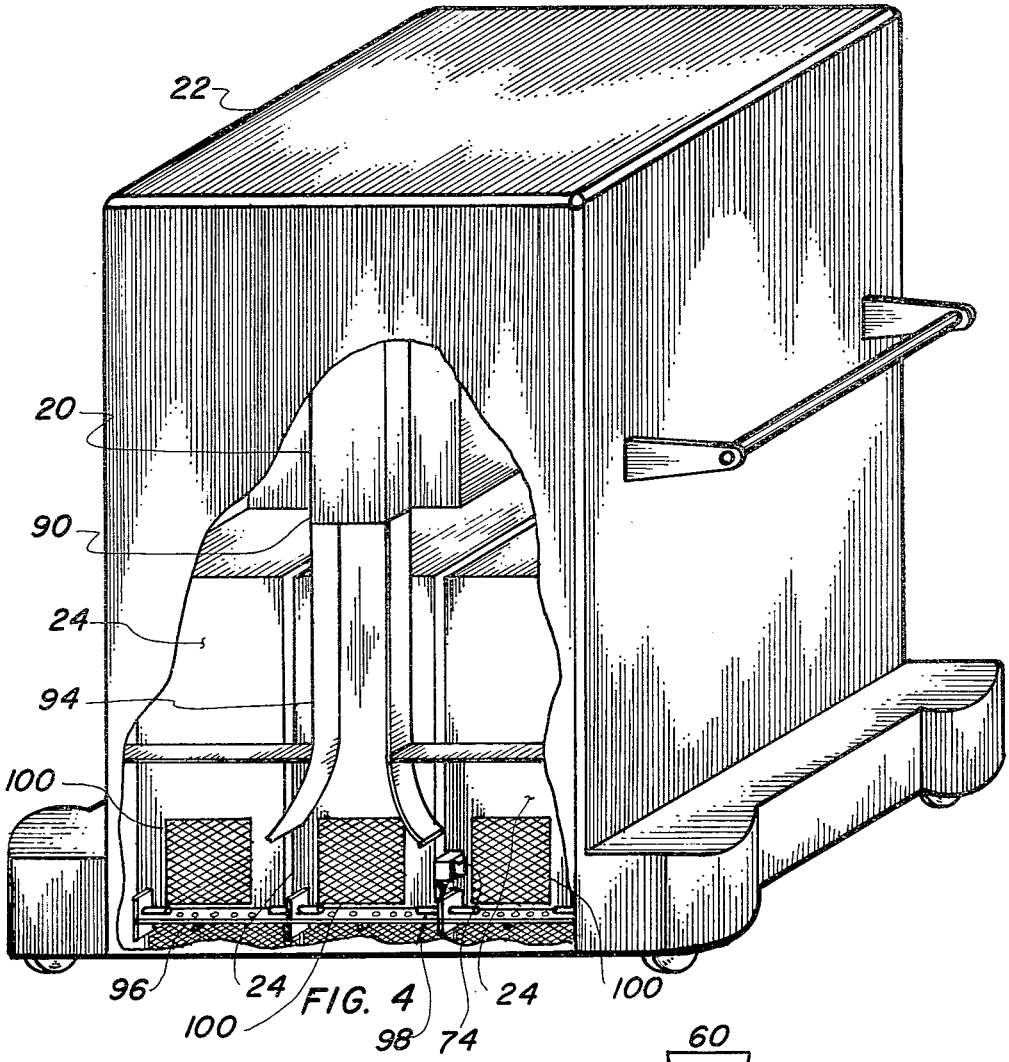
FIG. 4 is a partial isometric view of the transporter partially cut-away to show the air chiller and damper arrangement.
Figure 5:
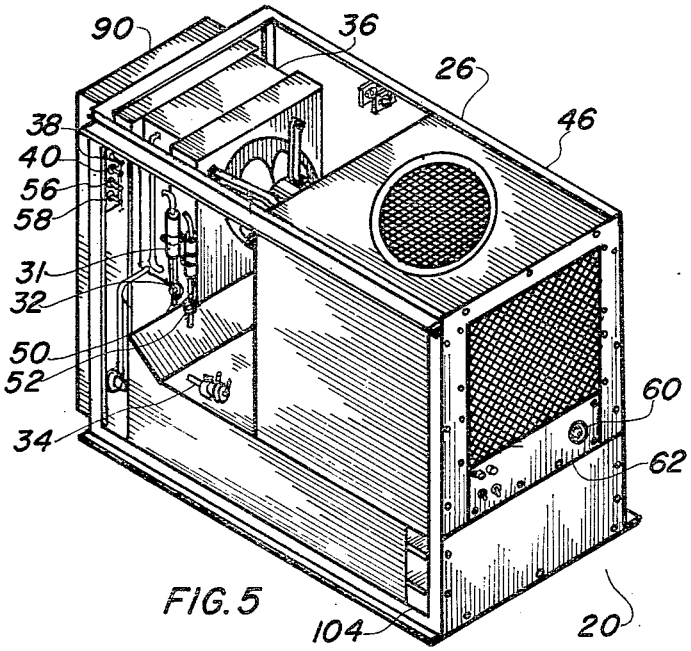
FIG. 5 is a partial isometric view of the preferred embodiment removed from the transporter.

Referring now more specifically to the referenced characters of the drawings, the invention in the preferred embodiment, as shown in FIGS. 1 and 5, utilizes a chiller unit 20 installed inside a portable transporter 22 to cool and maintain temperature of at least three airborne entree carts 24. The chiller unit 20 consists of a single frame 26 of structural material, such as steel or aluminum in extruded shapes or formed from flat stock, or the like. Housed within the frame 26 are two separate refrigeration systems and their accompanying components and accessories. Both systems are the vapor cycle type using halocarbon refrigerant. Many compositions of refrigerant may be used, however, R-12 dichlorodifluoromethane is preferred as a cooling agent.

The first refrigeration system contains an alternating current circuit utilizing commercial power common to the industry, such as 115 volts single phase 60 hertz. A hermetic compressor 28 operates in a conventional manner, changing the refrigerant from a low pressure gas to a high pressure gas where it is introduced into a condenser coil 30, where the refrigerant gives up heat and condenses from a gas to a liquid rejecting latent heat in the process, also providing subcooling. The condenser 30 is the tube and fin type, however, it is circuited to use only a portion of the surface for the first refrigeration system. It is composed of round, thin wall metallic tubes, preferably copper, penetrating thin, metallic fins with extruded collars to maintain direct contact of the metals extending the effective surface of the coil. The condensed liquid refrigerant passes through a dehydrator 31 and sight glass 32, where any water or foreign matter is removed. The flow continues to a first thermostatic expansion valve 34, where the liquid is metered through a variable orifice throttling and controlling the flow into a direct expansion evaporator coil 36 of similar construction to the condenser 30. At the valve orifice, the refrigerant begins to change state and adiabatic expansion takes place changing the refrigerant from a liquid to a gas, absorbing heat utilizing the latent heat of vaporization effect. The then superheated low pressure, low temperature gas returns to the compressor 28 to continue the cycle. Access ports 38 and 40 are provided for service gauges and charging in the high and low pressure sides, respectfully. Ambient air is moved across the condenser coil 30 with a propeller fan 42 directly connected to the shaft of an A.C. electric motor 44. The condenser air is restricted to an insulated compartment 46, thermally isolating the compartment from the balance of the apparatus. This compartment 46 contains the high pressure side of the circuit, including the condenser coil 30 and compressors 28 and 48. Ambient air is introduced horizontally through the condenser coil 30 and is discharged vertically through the fan 42 to atmosphere.

The second refrigeration system operates in the same basic manner, starting with a low temperature, low valve clearance hermetic refrigeration compressor 48. The compressor pressurizes the refrigerant gas passing it into the condenser coil 30 where it is circuited into the portion unused by the first refrigeration system. This single interlaced circuit condenser coil is, therefore, used in common with both refrigeration systems, as it shares the fins and casing, as well as the air flow from the condenser fan 42, however, the passes of the refrigeration system are staggered, maintaining their individual isolation. A similar dehydrator 50 and sight glass 52 are inserted in the liquid line from the condenser 30. The refrigerant continues through a conduit to a second expansion valve metering the flow into a plurality of eutectic plates 54 consisting of an enclosure housing, a serpentine metallic refrigerant tube surrounded by a liquid composition, having the characteristics of a low freezing point and high total heat content. As the adiabatic expansion takes place in the tubes, the refrigerant extracts the heat from the solution in the plates utilizing the latent heat of fusion and changing it from a liquid to a solid. This cooling effect can, therefore, be stored for later use and the flow of refrigerant is stopped when the plates 54 are completely frozen. In order to maintain a gaseous state in the suction side of the second refrigeration system, thereby preventing slugging of the compressor, the suction line is routed to the evaporator coil 36, where it is circuited into a plurality of passes prior to entering the suction side of the compressor 48. Access ports 56 and 58 are located near and function in the same manner as the first system.

Figure 6:
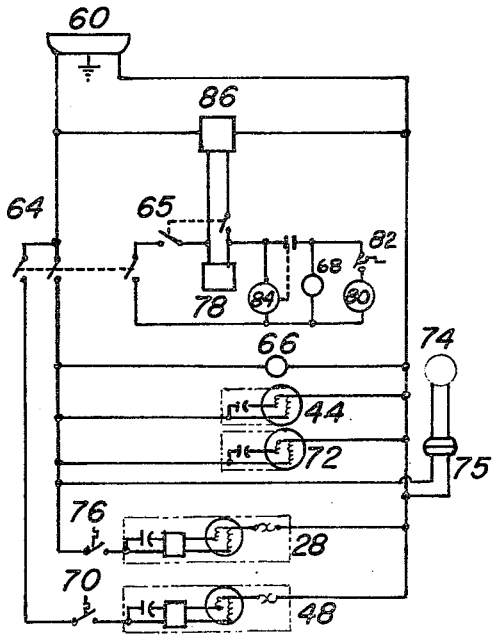
FIG. 6 is an electrical schematic diagram indicating the interconnecting electrical components of the system.

The alternating current electrical power circuit of the first refrigeration system, shown in FIG. 6, is supplied power from a fixed external source preferably 115 volt single phase 60 hertz through an electrical cord or cable. The cord is equipped with a female plug (not shown) that interfaces with a male receptacle 60 on the air chiller 20. A control panel and removeable door 62 is located directly below the condenser coil 30. The front face contains the above mentioned receptacle 60 and a triple pole, single throw toggle switch 64 labeled "kitchen" along with a double pole, single throw toggle switch 65 labeled "truck." Directly above the switches are individual indicator lights 66 and 68, respectfully, containing the same indicia.

The circuit operates as follows; when the triple pole switch is thrown, the first pole energized the second refrigerant compressor 48, which continues to operate until a second air temperature thromostat 70 opens contact controlling the temperature of the eutectic plates 54. The second pole of the switch energized the "kitchen" indicator light 66 along with the condenser fan motor 44 and the evaporator fan motor 72. Continuing, a female receptacle 75 provides electrical power to an electromechanical solenoid 74 located in the transporter 22. Finally, the refrigerant compressor 28 in the first system is energized and is controlled by a first air temperature thermostat 76, located in the return air stream of the unit 20. The entire alternating current power circuit is controlled by this on-off switch 64. However, in addition, both refrigerant compressors 28 and 48 contain inherent motor overload protection.

The direct current electrical power circuit utilizes a plurality of rechargeable storage batteries 78 supplying the power source becoming completely self-contained within the unit 20. The circuit controls a D.C. fan motor 80 that is energized when the "truck" double pole, toggle switch 65 is thrown to the "on" position. The third pole of the "kitchen" switch 64 is located in this circuit, also preventing the fan motor 80 from operation while the alternating current power system is energized. The fan motor 80 is controlled by a third air temperature thermostat 82 located in the return air stream of the unit in close proximity to the first thermostat 76. A low voltage drop-out relay 84 is positioned within this circuit having a coil across the poles sensing the voltage and opening a set of contacts on the negative side of the fan motor 80 if the batteries 78 are undercharged or malfunctioning. Finally, an A.C. to D.C. battery charger 86 is interconnected between the two circuits supplying continuous D.C. voltage to charge the batteries 78, except when operating on D.C. power itself.

The two toggle switches 64 and 65 control the unit and the lights labeled "kitchen" 66 and "truck" 68 indicating when each mode is energized. When the unit is in the kitchen mode, the truck mode will not function. The truck mode light 68 and fan 80 will not function when the batteries 78 are undercharged. This condition is intended to inform operating personnel to either charge or attend to the onboard batteries 78. The battery charger 86 is energized when power is connected to the unit even when the "kitchen" switch 64 is in the "off" position. This feature allows the batteries 78 to deep charge at any time the unit is connected to A.C. power, extending the life of the batteries 78.

The air flow arrangement includes both the portable transporter 22 and the chiller 20, as the chiller 20 is located within the top half of the transporter 22 and becomes part of the return air plenum. Air is moved through the evaporator coil 36 by an evaporator fan 88 directly connected to the shaft of the evaporator fan motor 72. The air is forced through the fins and tubes of the evaporator coil 36 reducing the temperature, and in some cases, removing moisture from the air when the ambient is below the actual dew point. The cooled air is directed through a discharge duct 90 flowing downward from the rear of the unit 20. An air damper 92 is located within this duct 90 and is rotatably hinged immediately below the discharge side of the evaporator coil 36. The damper 92 is spring loaded with a damper spring 94 attached on one end to the damper 92 and the second end to the duct 90. As the evaporator fan 88 increases the air pressure, the spring tension of the air damper 92 is overcome and it is rotated flat against the eutectic plate 54 air inlet, isolating the air flow from the first and second refrigeration systems. The cooled air then leaves the chiller 20 and enters a diverging plenum 94 that is in intimate contact with the discharge duct 90 allowing expansion of the air reducing the velocity pressure. Housed within the diverging plenum 94 is a bypass damper 96 which is energized closed in the A.C. circuit operating mode by the electromechanical solenoid 74. A tension spring 98 is in bias with the solenoid 74 opening the damper 96 when A.C. power is not in use. When closed, the cooled air flow is directed into individual food tray carts 24 that are stored within the transporter 22 for ultimate pulldown storage and transportation. Any number of food tray carts 24 may be housed within the transporter 22, however, the preferred embodiment is directed to three individual carts. The carts 24 are equipped with air inlet openings 100 for use with both the transporter 22 and onboard aircraft cooling equipment. These openings 100 interface with the diverging plenum 94 and allow the cooled pressurized air to be distributed throughout the carts, cooling the entree plates stored therein and be discharged from the cart. The air leaving the carts is directed around the outside and is pulled by negative pressure through the internal structure of the transporter 22. The return air enteres the chiller unit 20 through the open end to the negative pressure side of the evaporator fan 88 completing the air flow arrangement for the first refrigeration system on A.C. power supply.

When the second refrigeration circuit has pre-cooled the eutectic plates 54 using A.C. power and the transporter 22 is ready for movement away from the fixed power source, the D.C. power circuit is energized. Air is forced by a D.C. fan 102 connected to the fan motor 80 through the bottom portion of the discharge duct 90. The air damper 92 being spring loaded closed, with damper spring 94, retains the position being pressurized from the bottom isolating the air flow from the first refrigeration system allowing flow only downward. As the D.C. system has reduced electrical power, the air flow is also proportionate to the power available. The air leaves the discharge duct 90 and enters the diverging plenum 94 where the bypass damper is spring loaded open by tension spring 98. The majority of the air then passes the inlet openings 100 in the carts 24 and is allowed to flow freely around the structure of the transporter 22 with some portion entering the inlet openings balancing the static pressure through or around the carts. The air is returned through openings 104 in the sides of the chiller unit 20 directly beneath the condenser compartment 46. The air passes directly over the eutectic plates 54 absorbing heat as the plates 54 change state from a solid to a liquid, utilizing the latent heat of fusion of the eutectic solution. The then cooled air enters the suction side of the D.C. fan completing the air flow arrangement for the second refrigeration system. Temperature is controlled with the third thermostat 82 which cycles the D.C. fan motor 80 "off" and "on" to satisfy the demand. Defrost of the eutectic plates 54 occurs during periods when the transporter is not connected to A.C. power. The air damper 92 is spring loaded open allowing free connection over the plates 54 for this purpose. The condensate is piped to a drain pan under the transporter 22.

While the invention has been described in complete detail and pictorially shown in the accompanying drawings it is not to be limited to such details, since many changes and modifications may be in the invention without departing from the spirit and the scope thereof. Hence, it is described to cover any and all modifications and forms which may come within the language and scope of the appended claims.

I claim:

1. A transporter air chiller for cooling foodstuffs in airborne storage and serving carts comprising:

(a) a unitized vapor cycle refrigeration apparatus having a pair of refrigeration systems within a single frame and a common air flow arrangement for providing product cooling by removing heat through a refrigerant cooling agent;

(b) an alternating circuit electrical power circuit integral with said first refrigeration system for activating cooling and providing air flow by electromotive means;

(c) an alternating current and a direct current electrical power system integral with said second refrigeration system for cooling, storing and providing air flow of said common arrangement;

(d) an air damper within said air flow arrangement rotatably attached on one side to said frame for isolating air flow from said first and second refrigeration systems allowing cooling effect from either circuit not in concert; and, (e) an insulated compartment in said chiller for housing the high pressure side of said refrigeration systems providing thermal isolation from the balance of said apparatus due to inherent low heat transfer characteristics while allowing ambient air to circulate through said refrigeration systems.

2. A transporter air chiller for cooling foodstuffs in airborne storage and serving carts comprising:

(a) a unitized vapor cycle refrigeration apparatus having a pair of refrigeration systems within a single frame and a common air flow arrangement for providing product cooling by removing heat through a refrigerant cooling agent;

(b) an alternating circuit electrical power circuit integral with said first refrigeration system for activating cooling and providing air flow by electromotive means;

(c) an alternating current and a direct current electrical power system integral with said second refrigeration system for cooling, storing and providing air flow of said common arrangement;

(d) an air damper within said air flow arrangement rotatably attached on one side to said frame for isolating air flow from said first and second refrigeration systems allowing cooling effect from either circuit not in concert;

(e) a plurality of rechargeable storage batteries located within said direct current electrical power circuit, (f) a battery charger electrically connected to said batteries and fixed electrical alternating current source for deep charging said batteries by rectifying said current providing energy for storage; and, (g) a low voltage drop-out relay in said power circuit in parallel with said batteries disengaging said circuit when the voltage is reduced beyond a usable level.

3. A transporter air chiller for cooling foodstuffs in airborne storage and serving carts comprising:

(a) a unitized vapor cycle refrigeration apparatus having a pair of refrigeration systems within a single frame and a common air flow arrangement for providing product cooling by removing heat through a refrigerant cooling agent;

(b) an alternating circuit electrical power circuit power circuit integral with said first refrigeration system for activating cooling and providing air flow by electromotive means;

(c) an alternating current and a direct current electrical power system integral with said second refrigeration system for cooling, storing and providing air flow of said common arrangement;

(d) an air damper within said air flow arrangment rotatably attached on one side to said frame for isolating air flow from said first and second refrigeration systems allowing cooling effect from either circuit not in concert; and, (e) a spring attached to said damper on the first end and said frame on the second end to divert said air flow from said alternate current refrigeration air flow system and said direct current refrigeration air flow system.

4. A transporter air chiller for cooling foodstuffs in airborne storage and serving carts comprising:

(a) a unitized vapor cycle refrigeration apparatus having a pair of refrigeration systems within a single frame and a common air flow arrangement for providing product cooling by removing heat through a refrigerant cooling agent;

(b) an alternating circuit electrical power circuit integral with said first refrigeration system for activating cooling and providing air flow by electromotive means;

(c) an alternating current and a direct current electrical power system integral with said second refrigeration system for cooling, storing and providing air flow of said common arrangement;

(d) an air damper within said air flow arrangement rotatably attached on one side to said frame for isolating air flow from said first and second refrigeration systems allowing cooling effect from either circuit not in concert; and, (e) a plurality of eutectic plates in the low pressure side of said direct current refrigeration system providing a storage effect when changed state from a liquid to a solid by cooling of said refrigeration system and absorbing heat when said air flow arrangement passes over the surface thereof.

5. A transporter air chiller for cooling foodstuffs in airborne storage and serving carts comprising:

(a) a unitized vapor cycle refrigeration apparatus having a pair of refrigeration systems within a single frame and a common air flow arrangement for providing product cooling by removing heat through a refrigerant cooling agent;

(b) an alternating circuit electrical power circuit integral with said first refrigeration system for activating cooling and providing air flow by electromotive means;

(c) an alternating current and a direct current electrical power system integral with said second refrigeration system for cooling, storing and providing air flow of said common arrangement;

(d) an air damper within said air flow arrangement rotatably attached on one side to said frame for isolating air flow from said first and second refrigeration systems allowing cooling effect from either circuit not in concert; and, (e) a direct expansion evaporator coil in said alternating current refrigeration system providing the cooling effect when air from said air flow arrangement passes over the surface thereof.

6. An arrangement for cooling and conveying a plurality of airborne food tray carts having air circulation inlet and outlet ports using a portable transporter having means to contain cooling apparatii and air circulation passageways comprising:

(a) a unitized vapor cycle refrigeration apparatus contained within said transporter having at least two separate refrigeration systems within a single frame, and a common air flow arrangement; and, (b) a bypass damper with actuating means integral with said transporter and in direct communication with said air flow arrangement of said unitized vapor cycle refrigeration apparatus for directing air flow through said food tray cart inlet ports when operating on said alternating current electrical power or when operating on said direct current electrical power bypassing some portion of air from said carts to said air circulation passageways surrounding said carts for maintaining the cooling effect thereof.

7. The bypass damper actuating means of claim 6 further comprising:

an electro-mechanical solenoid in bias with a tension spring energized by said alternating current electrical power circuit of said first refrigerating system.

* * * * *